United States Patent [19]

Sinclair

[11] Patent Number: 4,573,858

[45] Date of Patent: Mar. 4, 1986

[54] CLAMPING ATTACHMENT FOR A LIFT TRUCK HAVING TWO PIVOTING ARMS

[75] Inventor: Stuart W. Sinclair, Lake Jackson, Tex.

[73] Assignee: Long Reach Manufacturing Co., Houston, Tex.

[21] Appl. No.: 580,990

[22] Filed: Feb. 16, 1984

[51] Int. Cl.[4] ..... B66C 1/42

[52] U.S. Cl. ..... 414/620; 91/189 R; 294/88; 414/621; 414/911

[58] Field of Search ..... 414/619, 620, 621, 622, 414/911, 912; 294/88; 91/189 R, 516

[56] References Cited

U.S. PATENT DOCUMENTS

| | | | |
|---|---|---|---|
| Re. 23,694 | 8/1953 | Ehmann | 414/621 |
| Re. 26,369 | 4/1968 | Ellis | 414/620 |
| 2,475,367 | 7/1949 | Avery | 414/621 |
| 2,560,438 | 7/1951 | Guinn, Jr. | 414/621 |
| 2,815,878 | 12/1957 | Vance | 414/620 |
| 2,874,862 | 2/1959 | Farmer et al. | 414/620 |
| 3,407,951 | 10/1968 | Faust et al. | 414/621 |
| 3,604,745 | 9/1971 | Sinclair | 414/621 X |
| 3,878,769 | 4/1975 | Farmer | 294/88 X |
| 3,896,957 | 7/1975 | Sinclair | 414/620 |
| 4,127,205 | 11/1978 | Farmer et al. | 414/620 |
| 4,177,000 | 12/1979 | Weinert et al. | 414/620 |
| 4,227,850 | 10/1980 | Farmer et al. | 414/620 |
| 4,248,471 | 2/1981 | LaBounty | 294/88 |
| 4,349,305 | 9/1982 | Wynn et al. | 91/516 X |
| 4,435,119 | 3/1984 | House | 414/620 |

*Primary Examiner*—Robert J. Spar
*Assistant Examiner*—Stuart J. Millman
*Attorney, Agent, or Firm*—Fulbright & Jaworski

[57] ABSTRACT

A clamping attachment with a hydraulically actuated pivoting long arm and a pivoting short arm. The hydraulic actuators are connected in parallel where both arms move simultaneously inwardly until one arm contacts a load and stops and the second arm will continue inwardly. A biasing valve insures that the long arm opens first before the short arm opens. The long arm is actuated by first and second crank links to provide maximum force at the open position. The short arm is pivotally connected closer to the center line of the frame than the long arm allowing the long arm to be positioned in the maximum force position, allows positioning of the load close to the frame center line and reduces travel of the long arm. A swivel connection in the hydraulic control system prevents operation of any arm in the down position. The frame of the clamp is asymmetrical.

14 Claims, 8 Drawing Figures

Fig. 3
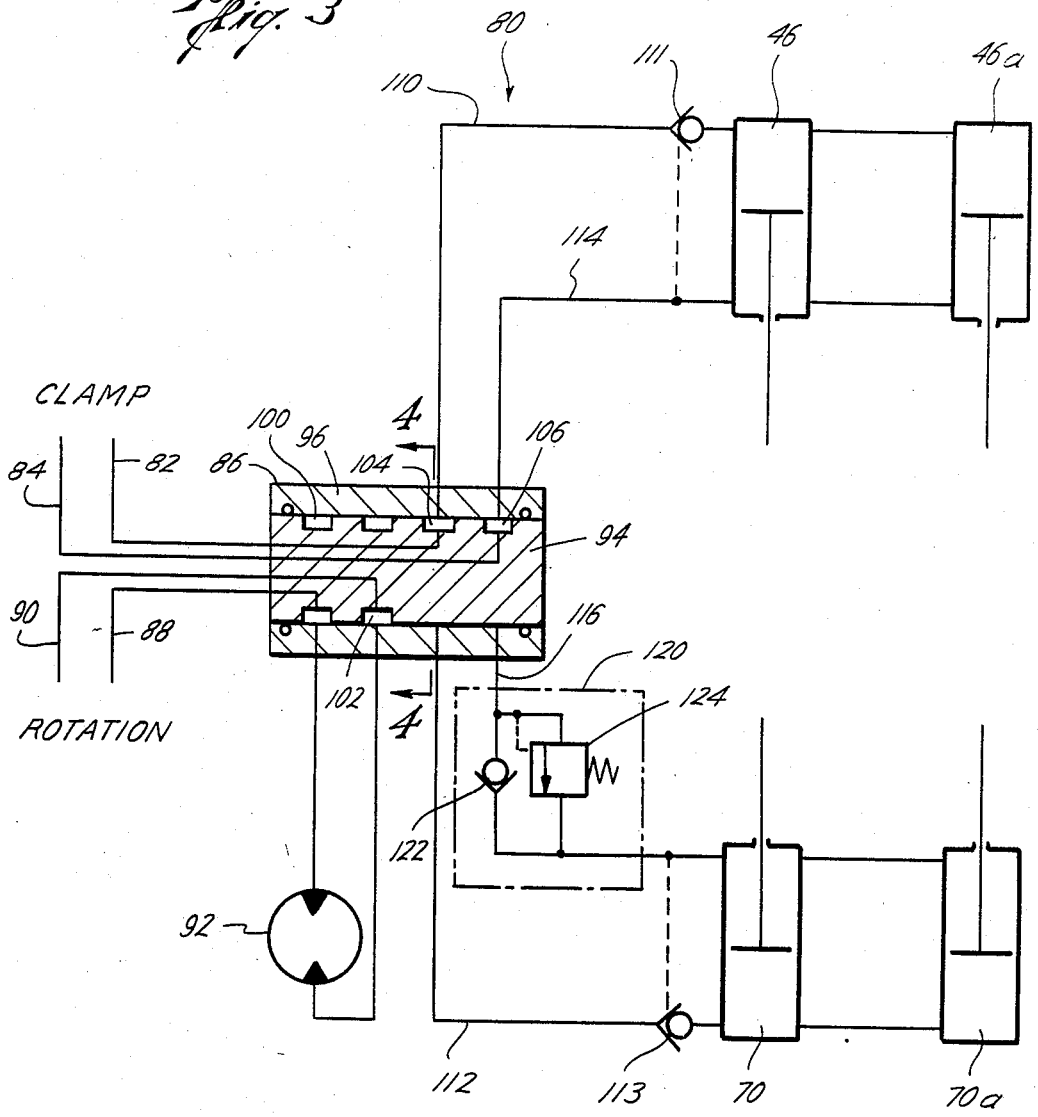
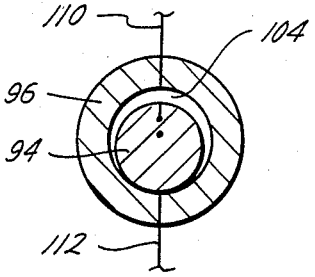
Fig. 4

CLAMPING ATTACHMENT FOR A LIFT TRUCK HAVING TWO PIVOTING ARMS

BACKGROUND OF THE INVENTION

Various U.S. patents such as U.S. Pat. No. 2,874,862, U.S. Pat. No. Re. 26,369; U.S. Pat. Nos. 3,604,745; 2,815,878; 2,475,367; and 3,878,769 have disclosed various structures for a paper roll clamp some of which utilize thin arms to grab a roll but minimize damage to adjacent rolls, optimize the truck clamp capacity while minimizing weight and maneuverability by using lightweight and thin clamps, and use long and short moving arms in combination with rotation of a clamp to maneuver rolls into various positions.

The present invention is directed to various improvements in a clamping attachment for use on a lift truck for moving paper rolls or the like in which damage to the load is kept at a minimum, productivity is increased, the clamping attachment allows the truck to have a greater capacity, the gripping force of the clamping attachment reduces proportionally during closing but it is sufficient to handle various size loads, and the clamping attachment carries the load closer to the centerline to improve stability.

SUMMARY

The present invention is directed to a clamping attachment for paper rolls or the like for use in a lift truck. The attachment includes a frame having first and second arms. The first arm and preferably the second arm are pivotally connected to the frame with the second arm shorter than the first arm. However, the short arm may be fixedly secured to the frame in some applications. First and second hydraulic piston and cylinder means are connected to the first and second arms, respectively, for moving the arms towards each other for clamping loads therebetween and away from each other to release loads. The first and second hydraulic means are connected in parallel whereby both arms simultaneously move inwardly during the closing or clamping operation until one arm contacts the load whereby the one arm will stop, but the other arm will continue an inward movement until it grips the load.

Another feature of the present invention is the provision of a biasing valve connected to the second hydraulic means for initially preventing the hydraulic fluid from opening the short arm whereby on opening the clamp the long arm always opens first while the short arm remains in the closed position. Once the long arm is completely open the biasing valve opens and the short arm opens.

Another feature of the present invention is the provision of a swivel connection in the hydraulic supply to the first and second hydraulic piston and cylinder means which shuts off the fluid supply to the hydraulic means of any arm which is in the down position which allows the operator to grip the loads with a minimum of arm movement and maximum speed.

A still further object of the present invention is the provision of a linkage in the long arm to alter the mechanical advantage to produce a force needed to match the weight of the rolls of a given length which is proportional to the square of the diameter as well as reducing the bulk and weight of the arm to carry the required loads. One end of the first hydraulic piston and cylinder is pivotally connected to the frame and the second end is pivotally connected to a cylinder pin. A first crank link has its first end pivotally connected to the frame and a second end pivotally connected to the cylinder pin. A second crank link has a first end pivotally connected to the cylinder pin and a second end pivotally connected to the first arm whereby actuation of the first hydraulic piston and cylinder causes the maximum gripping force to occur when the first or long arm is completely open and reduces proportionally during closing. Preferably the connection of the first end of the first crank link to the frame, the connection of the second end of the second crank link to the first arm, and the pivot connection of the first arm to the frame are all on one side of the longitudinal axis of the first piston and cylinder means.

Still a further object of the present invention is wherein the pivot connection of the short arm to the frame is closer to the centerline of the frame than the pivot connection of the long arm which allows the long arm to be positioned in its maximum force position and/or allows positioning of a load close to the frame centerline, and reduces travel of the long arm. The second hydraulic piston and cylinder means is pivotally connected to the short arm and is pivotally connected to the frame at a location further from the centerline of the frame than the pivot connection of the short arm to the frame.

Yet a still further object of the present invention is wherein the length of the frame from the centerline to the outer edge on the short arm side is less than the length of the frame from the centerline to the outer edge on the long arm side to provide an asymmetrical body.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIG. 3 is a hydraulic schematic view of the hydraulic controls for movement of the arms, FIG. 4 is a cross-sectional view taken along the line 4—4 of FIG. 3, FIGS. 5A and 5B are vector diagrams showing arm load comparisons between a conventional design of FIG. 5A and the improved design of the present invention in FIG. 5B, FIGS. 6A and 6B are loading diagrams showing load comparisons between a conventional design shown in FIG. 6A with the improved design of the present invention shown in FIG. 6B.

DESCRIPTION OF THE PREFERRED EMBODIMENT

Figure 1:
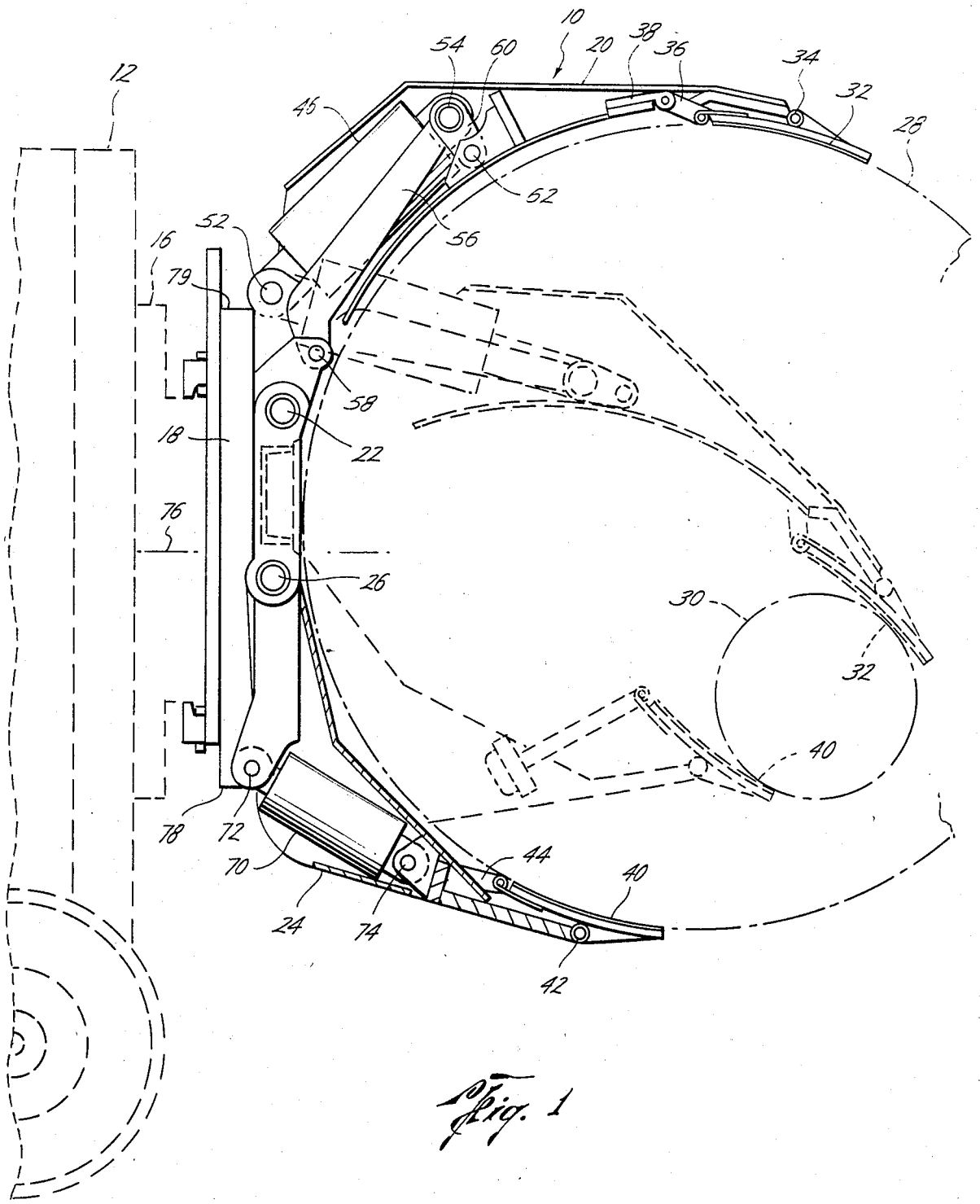
FIG. 1 is an elevational view of the clamp attachment of the present invention showing the clamp of the present invention attached to a lift truck and showing the clamp in position for maximum roll diameter in full lines, and for minimum roll diameter in broken lines.

Referring now to the drawings, and particularly to FIG. 1, the reference numeral 10 generally indicates the clamp of the present invention which is adapted to be conventionally connected to any suitable type of lift truck 12. The lift truck 12 includes a carriage 16 which may provide conventional elevating and tilting functions. The clamp 10 generally includes a body or frame 18 suitably attached to the carriage 16, a first or long arm 20 pivotally connected to the frame 18 by pivot connections 22 and 22*a*, and a second or short arm 24 pivotally connected to the frame 18 by pivot connections 26 and 26*a*. The arm 24 is shorter than the arm 20 to enable the clamp 10 primarily to pick up horizontal rolls from the floor and to reach in and engage, clamp and carry various sized loads 28 and 30 from and into crowded locations. In some applications, the short arm 24 may be fixedly secured to the frame 18.

As is conventional, the long arm 20 includes a top swivel pad 32 which is rotatable about pin 34 and provided with a stop link 36 and bracket 38. And the short arm 24 also includes a conventional swivel pad 40 on pivot pin 42 connected to a stop link 44.

First and second hydraulic piston and cylinder means are connected to the first and second arms 20 and 24, respectively, for closing or moving the arms 20 and 24 towards each other to a closed position or gripping position for clamping loads such as paper rolls 28 and 30 therebetween and opening or moving the arms away from each other to an open position to release the load.

Figure 2:
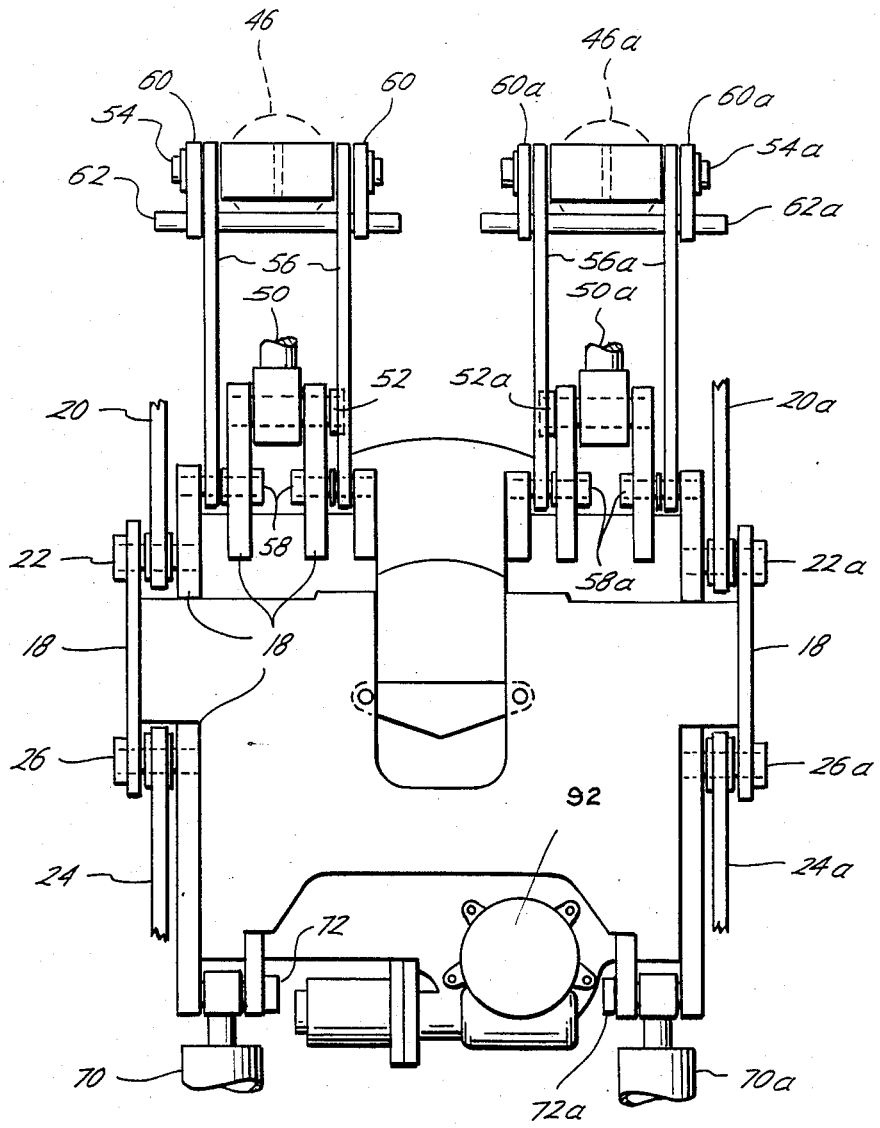
FIG. 2 is a fragmentary side elevational view of the clamp of FIG. 1 illustrating the powering of the pivoting arms.

The first hydraulic piston and cylinder means, FIGS. 1 and 2, may include hydraulic piston and cylinders 46 and 46*a* which are connected to a linkage mechanism which alters the travel of the long arm 20 by changing its mechanical advantage to produce a force sufficient to match the roll weights of various loads such as 28 and 30. That is, roll weights are generally proportional to their diameters and it is important to have the maximum gripping force when the long arm 20 is in the expanded position. While my prior U.S. Pat. No. 3,604,745, discloses a toggle arm structure for so modifying the force produced by the long arm, the present invention provides a different structure which not only develops the force required, but reduces the cross-bending in the body or frame, and provides links which are primarily simple tensile and compressive members thereby reducing the necessity for large bulky and heavy sections. Thus, one end of the hydraulic piston and cylinder assemblies 46 and 46*a* have one end, such as the piston end 50 and 50*a*, respectively, pivotally connected to the frame 18 by a pivot connection such as rod pin 52 and 52*a*, respectively, The second end, such as the cylinder ends of the assemblies 46 and 46*a*, are pivotally connected to cylinder pins 54 and 54*a*, respectively. First crank links 56 and 56*a*, respectively, have their first ends pivotally connected to the cylinder pins 54 and 54*a*, respectively, and a second end pivotally connected to the frame 18 by a radius link pin 58 and 58*a*. Second crank links 60 and 62*a* each have a first end pivotally connected to the cylinder pins 54 and 54*a* and a second end pivotally connected to the first arm 20 by a pivot connection such as crank pin 62 and 62*a*, respectively. Actuation of the hydraulic piston and cylinder assemblies 46 and 46*a* moves the arm 20 from the extended position shown in the solid outline in FIG. 1 to the dotted position shown in FIG. 1 in a path which provides a greater gripping force on the larger size loads with the gripping force being reduced proportionally during closing. The linkage shown not only provides the required force to match the roll weight depending upon the diameter of the loads 28 and 30, but reduces the stresses in the frame 18 and reduces the bulk and weight of the arm 20, as will be more fully described hereinafter. In particular, the linkages allow the use of a shorter piston and cylinder assembly 46 and 46*a* thereby reducing the thickness of the arm 20 and reducing the so-called "elbow" effect of the long arm which reduces the tendency for the arm 20 to contact and damage adjacent loads. As best seen in FIG. 1, the connection 58 of the first end of the first crank 56 to the arm 20, the connection 62 of the second end of the second crank link 60 to the first arm 20, and the pivot connection 22 of the first arm to the frame 18 are all on one side of the longitudinal axis of the first piston and cylinder means 46 and 46*a*.

Second hydraulic piston and cylinder means such as hydraulic piston and cylinder assemblies 70 and 70*a* are provided for pivoting the short arm 24 around its pivot connection 26. Thus the assemblies 70 and 70*a* are connected at one end to a pivot connection or rod pin 72 and 72*a*, respectively, to the frame 18. And the second ends are connected by pivot connection 74 and 74*a* to the arm 24.

It is to be particularly noted that the pivot connection 26 of the short arm 24 to the frame 18 is closer to the rotation centerline 76 of the frame than the pivot connection 22 of the long arm 20 to the frame. Furthermore, it is to be noted that the length of the frame 18 from the rotation centerline 76 to the outer edge 78 on the second arm or short arm 24 side is less than the length of the frame 18 from the center line 76 to the outer edge 79 on the long arm 20 side of the frame 18. These features have several important advantages. The asymmetrical body 18 does not limit the short arm 24 travel as the arm 24 can pass on the short side in picking up horizontal rolls. These features will provide a longer short arm 24 travel which in turn will reduce the length of the long arm cylinders 46 and 46*a*. This allows a greater diameter range of loads to be handled and to be handled at a maximum arm force and at its most efficient arm position with respect to inteference with rolls. This reduces damages to paper rolls by the long arm 20. Since the largest long arm force is exerted when the long arm 20 is opened as wide as possible, the short arm 24 may position the roll or load 28 or 30 so that the long arm 20 is in the maximum force position. In addition, the structure of the short arm 24 makes it possible to position a load or roll 28 and 30 close to the centerline 76, at a position near the center of gravity of rotation and reduce the twist on the mast of the carriage 12, and allow the short arm 24 to be more nearly equal to the long arm 20 when breaking out rolls that have less than the maximum diameter. The positioning of the pivot connection 26 for the short arm 24 allows the use of a smaller short arm cylinders 70 and 70*a* which again reduces the thickness of the arms, and adds to the ability of the short arm 24 to move out or become more equal to the long arm and reduces the required travel of the long arm 20.

Referring now to FIG. 3, the hydraulic schematic of the operation of the long arm 20 by the piston and cylinder assemblies 46 and 46*a* and the operation of the short arm 24 by the piston and cylinder assemblies 70 and 70*a* is best seen. Lines from the truck 14 such as hydraulic lines 82 and 84 provide the clamping and unclamping hydraulic supply fluid, respectively, for closing and opening the clamp 10. A swivel joint generally indicated by the reference numeral 86 is provided in the hydraulic lines between the hydraulic lines 82 and 84 and the piston and cylinder assemblies 46, 46*a*, 70 and 70*a*. A second circuit consisting of hydraulic supply lines 88 and 90 are provided connected through the swivel connection 86 to a rotation motor 92 for rotating the frame 18 relative to the truck 12. The swivel 86 includes a stator 94 and a rotor 96. The stator 94 includes a plurality of grooves 100, 102, 104, and 106. The grooves 100 and 102 are circular around the entire circumference of the rotor 94 and thus transmit hydraulic fluid from and to the rotation motor 92 through the lines 88 and 90 regardless of the relative position of the rotor 96 relative to the stator 94. However, the grooves 104 and 106 are as shown in the cross-sectional view of groove 104 of FIG. 4 whereby all hydraulic fluid to either arm 20 or 24 is blocked from actuating that arm in the event that that arm is in the down position. The down position refers to the position of the lower arm when the arms 20 and 24 are rotated into a vertical plane. That is, normally, to close the arms 20 and 24 hydraulic fluid comes from supply line 82 flows through the groove 104 to the line 110 to the cylinders 46 and **46*a* to extend these assemblies to move the long arm 20 inwardly. Simultaneously, these same fluids would flow from the groove 104 to the line 112 into the piston and cylinder assemblies 70 and 70*a* to move the short arm 24 inwardly. However, assuming that the short arm 24 is in the down position relative to the centerline 76, the rotor 94 would have the relative position with respect to the stator 96 as shown in FIG. 4 and therefore the groove 104 would be blocked from transmitting hydraulic fluid to the line 112 to operate the down positioned assemblies 70 and 70*a*. On the other hand, if the long arm 20 was positioned in the down position, the rotor 96 would be rotated whereby the stator 94 would block the incoming fluid line 110 and the assemblies 46 and 46*a*** would be inoperable.

Again, assuming that neither of the arms 20 or 24 are in the down position, fluid may be exerted from the line 84 through the swivel connection 86 to supply fluid to the groove 104 lines 110 and 112 and to the back side of all of the cylinders **46, 46*a*, 70 and 70*a*. This operation would push both the long arm 20 and the short arm 24 inwardly for clamping. However, if either of the long arm 20 or short arm 24 were in the down position, then their respective lines 110 and 112 would be blocked by the coaction between the stator 46 and the rotor 96 to prevent their operation. A similar operation will occur in opening the arms 20 and 24 in using groove 106 and lines 114 and 116**.

It is to be noted that in operation wherein neither the arms 20 or 24 are in the down position that hydraulic fluid will simultaneously flow to the lines 110 and 112 through the clamping check valves 111 and 113 and simultaneously into the cylinders **46, 46*a*, 70 and 70*a*. This will simultaneously move the long arm 20 and the short arm 24 in the clamping cycle toward the roll or loads 28 or 30. If one of the arms 20 or 24 comes into contact with the load before the other arm comes into contact with the load, the one arm will stop and the other arm will move in then the other arm will continue moving in until the other arm grips the load. Therefore, the clamp 10 is load sensitive in that the arms 20 and 24** move during the clamping operation, but the load is not moved. That is, both arms move in simultaneously during the clamping cycle until one arm comes into contact with the load.

The blocking swivel therefore locks either arm in the down position so that it will not move. This provides the benefit of faster handling. This allows the operator to grip the rolls with minimum arm movement and maximum speed. Thus, with the short arm 24 in the down position and fixed, the truck 12 may move up against a load and all of the fluid will then be transmitted through line 110 to actuate the long arm 20, with faster speed since the cylinders 70 and **70*a* are not receiving fluid and all of the fluid will flow into the hydraulic means 46 and 46*a***. The bottom arm not moving will not move the horizontal rolls away from the gripping position.

In opening the clamp 12, the long arm 20 always opens first while the short arm 24 remains in the closed position. This occurs because of the provision of the biasing valve 120 in the line 116 of the short arm 24. That is, assuming that opening fluid passes through line 84 to both lines 114 and 116, 116 will be blocked by the check valve 122 and the fluid will flow in line 114 to cylinder means 46 and **46*a* to open the long arm 20. In the event that the long arm 20 is opened to the extent of its travel and prevented from further movement, the pressure will build up in line 116 to pilot the biasing valve element 124 to the open position to provide fluid to the assemblies 70 and 70*a* in a direction to open the short arm 24. Thus, the biasing valve 120 opens the long arm 20 completely before the short arm 24 opens. In repetitive clamping operations, this allows the short arm 24 to remain stationary for easy positioning and more rapid roll handling. For example, in repeated clamping of small diameter rolls, the short arm may remain stationary and requires only a small movement of the long arm 20**. Again this feature allows rapid operation and high plan efficiencies.

In addition, the clamp 10 has less AET (attachment effective thickness), formerly called lost load than any comparable clamp on the market which is a measure of the effective thickness of the clamp and a lower rating is greater net truck capacity.

Figure 5A:
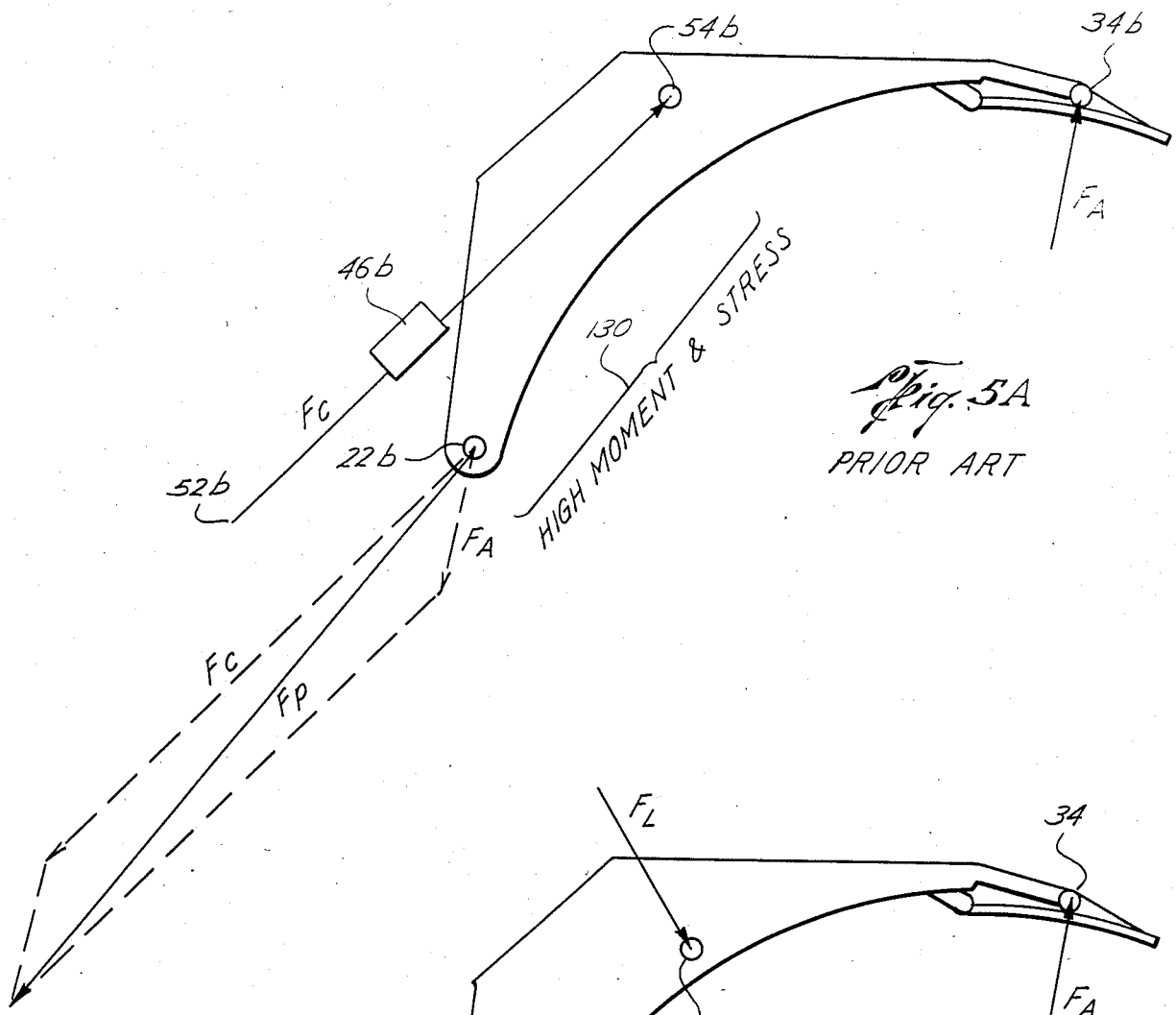
Fig. 5A PRIOR ART
Figure 5B:
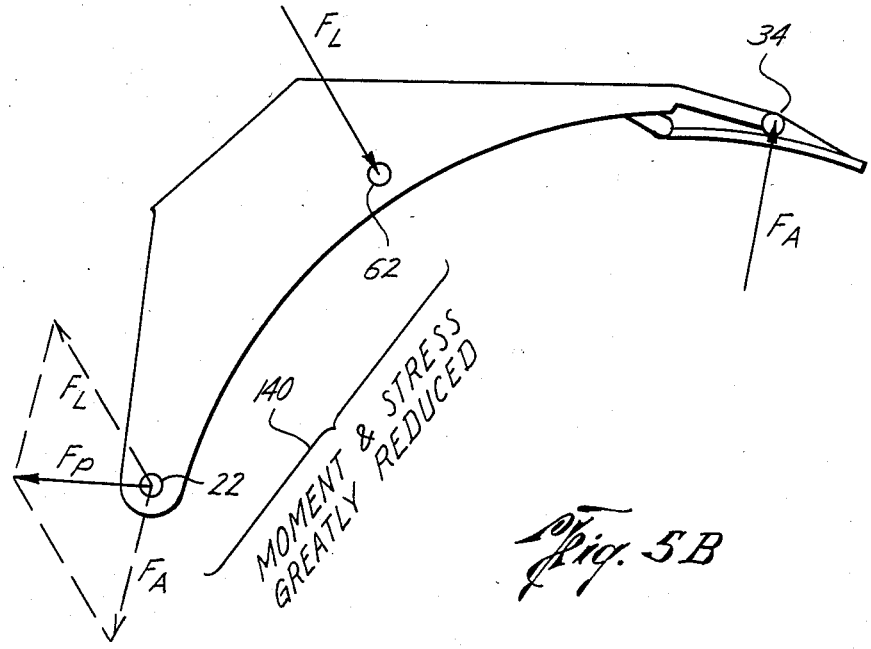

As has previously been indicated, the structure for operating the long arm 20 reduces the stresses in the frame 18 and reduces the bulk and weight of the arm 20. Referring now to FIG. 5A, the stresses and loads in a conventional long arm **20*b* is best seen in which the arm 20*b* is pivotally connected to a frame by a pivot connection 22*b* and a piston and cylinder assembly 46*b* is connected to one end 52*b* to the frame and at a second end 54*b* to the arm 20*b* without the linkages of the present invention. As indicated in FIG. 5A, the forces and stress produce high moments and stress in the area 130 of the arm 20*b*. On the other hand, the stresses and loading of the present design is best seen in FIG. 5B. As indicated, the moment and stress in the area 140** is greatly reduced. The notations $F_a$ is the force applied on the load, $F_c$ is the force of the piston and cylinder assembly, and $F_p$ is the force on the pivot pin.

Figure 6A:
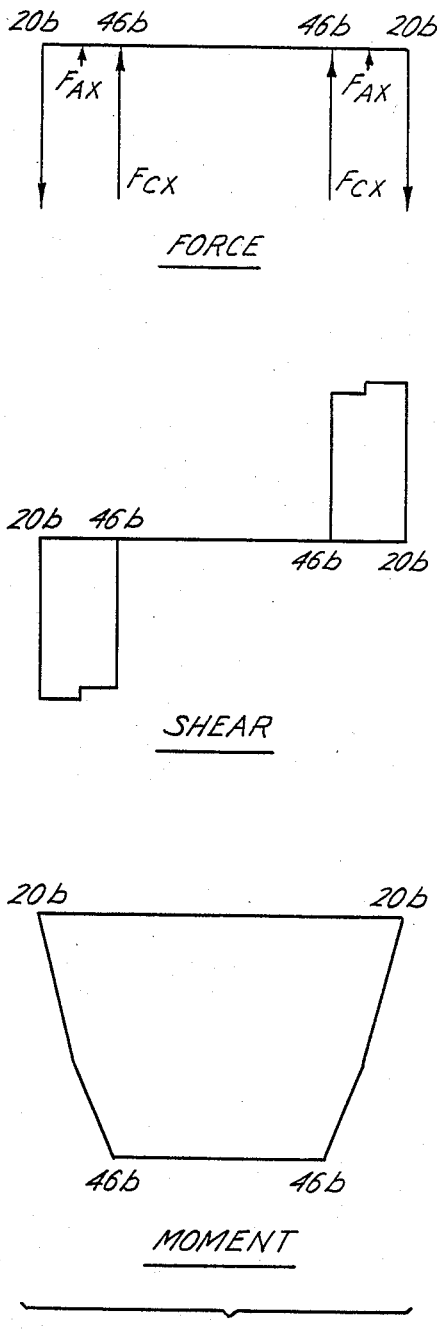
Fig. 6A PRIOR ART
Figure 6B:
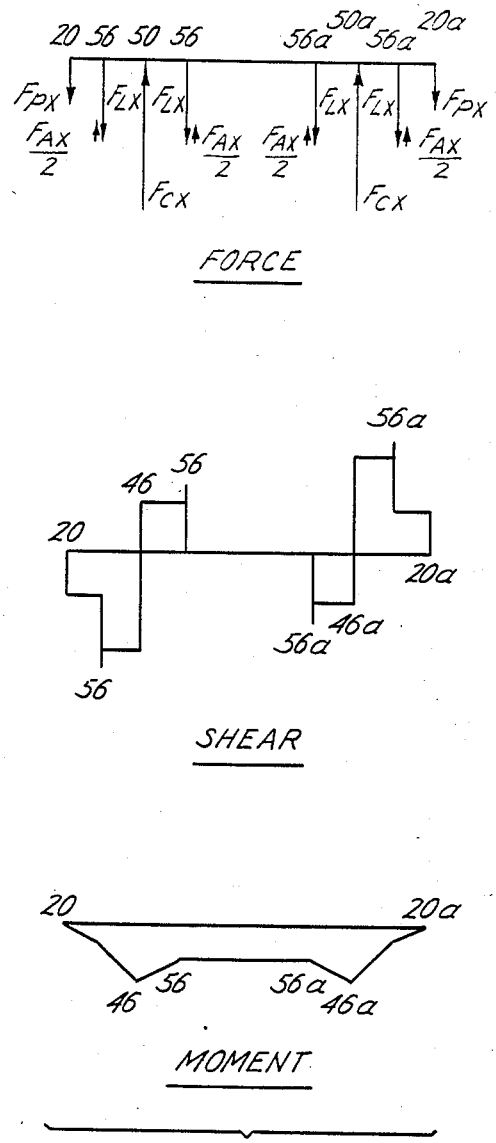

Referring now to FIGS. 6A and 6B, a comparison of the forces, shears and moments in the long arm between the conventional arm **20*b* shown in FIG. 5A and the present arm 20 shown in FIG. 5B are shown in graphs 6A and 6B**, respectively. Again, it is noted that both the shear and moment forces in the present design are much less than in a conventional design.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A clamping attachment for use on a lift truck comprising, a frame, a first arm pivotally connected to the frame, a second arm pivotally connected to the frame, said second arm being shorter than the first arm, first and second hydraulic piston and cylinder means connected to the first and second arms, respectively, for moving said arms toward each other to close for clamping loads therebetween and away from each other to open to release loads, said first and second hydraulic piston and cylinder means being connected in parallel whereby both arms simultaneously move inwardly until one arm contacts a load and said one arm will stop and the other arm will continue inward movement, and a biasing valve connected to said second hydraulic piston and cylinder means for initially preventing hydraulic fluid opening said second arm whereby on opening said arms the first arm opens while the second arm remains closed until the first arm completely opens, said biasing valve including a check valve for allowing the flow of hydraulic fluid from said second hydraulic piston and cylinder means.

2. The apparatus of claim 1 wherein the first hydraulic piston and cylinder means has one end connected to the frame and the second end is pivotally connected to a cylinder pin, and including, a first crank link having a first end connected to the frame and a second end connected to the cylinder pin, said first end being connected to the frame substantially in a plane with the cylinder pin and the point at which the first arm is pivotally connected to the frame when the clamp is open, and a second crank link, which is substantially perpendicular to the longitudinal axis of the first hydraulic piston and cylinder means when the clamp is open, having a first end pivotally connected to the cylinder pin and a second end pivotally connected to the first arm whereby actuation of the first hydraulic piston and cylinder rotates the first arm about the pivot connection to the frame and provides a greater gripping force on larger sized loads.

3. The apparatus of claim 2 wherein the connection of the first end of the first crank link to the frame, the connection of the second end of the second crank link to the first arm, and the pivot connection of the first arm to the frame are all on one side of the longitudinal axis of the first piston and cylinder means.

4. The apparatus of claim 1 wherein the pivot connection of the second arm to the frame is closer to the centerline of rotation of the frame than the pivot connection of the first arm to the frame thereby allowing the first arm to be positioned in the maximum force position, allows positioning of a load close to the frame centerline, and reduces travel of the long arm.

5. The apparatus of claim 4 wherein the second hydraulic piston and cylinder means is pivotally connected to the second arm and is pivotally connected to the frame at a location further from the centerline of rotation of the frame than the pivot connection of the second arm to the frame.

6. The apparatus of claim 4 wherein the length of the frame from the structure of rotation to the outer edge on the second arm side is less than the length of the frame from the centerline of rotation to the outer edge on the first arm side.

7. The apparatus of claim 1 including, means connected to the frame for rotating the frame and arms, and a swivel connection in the hydraulic supply to the first and second hydraulic means which shuts off the fluid supply to the hydraulic means of any arm in a down position.

8. A clamping attachment for use on a lift truck comprising, a frame, a first arm pivotally connected to the frame, a second arm connected to the frame, said second arm being shorter than the first arm, a hydraulic piston and cylinder means connected to the first arm for moving said first arm relative to the second arm for clamping loads therebetween and away from the second arm to release loads, one end of the hydraulic piston and cylinder means is connected to the frame and a second end is connected to a cylinder pin, a first crank link having a first end connected to the frame and a second end connected to the cylinder pin, said first end being connected to the frame substantially in a plane with the cylinder pin and the point at which the first arm is pivotally connected to the frame when the clamp is open, and a second crank link, which is substantially perpendicular to the longitudinal axis of the first hydraulic piston and cylinder means when the clamp is open, having a first end pivotally connected to the cylinder pin and a second end pivotally connected to the first arm whereby actuation of the hydraulic piston and cylinder rotates the first arm about the pivot connection to the frame and provides a greater gripping force on larger sized loads.

9. The apparatus of claim 8 wherein the second arm is pivotally connected to the frame and second hydraulic piston and cylinder means is connected between the frame and the second arm and the pivot connection of the second arm to the frame is closer to the centerline of the frame than the pivot connection of the first arm to the frame thereby allowing the first arm to be positioned in the maximum force position, allows positioning of a load closer to the frame centerline, and reduces travel of the long arm.

10. The apparatus of claim 9 wherein, said first and second hydraulic piston and cylinder means being connected in parallel whereby both arms simultaneously move inwardly until one arm contacts a load and said one arm will stop and the other arm will continue inward movement, and a biasing valve connected to said second hydraulic piston and cylinder means for initially preventing hydraulic fluid opening said second arm whereby on opening said arms the first arm opens while the second arm remains closed until the first arm completely opens.

11. The apparatus of claim 9 wherein the second hydraulic piston and cylinder means is pivotally connected to the second arm and is pivotally connected to the frame at a location further from the centerline of rotation of the frame than the pivot connection of the second arm to the frame.

12. The apparatus of claim 8 wherein the connection of the first end of the first crank link to the frame, the connection of the second end of the second crank link to the first arm, and the pivot connection of the first arm to the frame are all on one side of the longitudinal axis of the first piston and cylinder means.

13. The apparatus of claim 9 wherein the length of the frame from the centerline of rotation to the outer edge on the second arm side is less than the length of the frame from the centerline of rotation to the outer edge on the first arm side.

14. The apparatus of claim 10 including, means connected to the frame for rotating the frame and arms, and a swivel connection in the hydraulic supply to the first and second hydraulic means which shuts off the fluid supply to the hydraulic means of any arm in a down position.

* * * * *

UNITED STATES PATENT OFFICE

CERTIFICATE OF CORRECTION

Patent No. 4,573,858 Dated March 4, 1986

Inventor(s) Stuart W. Sinclair

It is certified that error appears in the above-identified patent and that said Letters Patent are hereby corrected as shown below:

Column 3, line 45, change the comma after "respectively" to -- . --

Column 7, line 64, delete "structure" and insert -- centerline --

Signed and Sealed this

*Eighth* Day of *July 1986*

[SEAL]

*Attest:*

DONALD J. QUIGG

*Attesting Officer*

*Commissioner of Patents and Trademarks*